US008411011B2

(12) United States Patent
Chao et al.

(10) Patent No.: US 8,411,011 B2
(45) Date of Patent: Apr. 2, 2013

(54) METHOD AND APPARATUS TO GENERATE CONTROL SIGNALS FOR DISPLAY-PANEL DRIVER

(75) Inventors: Hsing-Hui Chao, Tainan County (TW); Liang-Sheng Yang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 884 days.

(21) Appl. No.: 11/836,790

(22) Filed: Aug. 10, 2007

(65) Prior Publication Data

US 2008/0284703 A1 Nov. 20, 2008

(30) Foreign Application Priority Data

May 15, 2007 (TW) ..... 96117309 A

(51) Int. Cl.
*G09G 3/36* (2006.01)

(52) U.S. Cl. ..... 345/98; 345/99; 345/100

(58) Field of Classification Search ..... 345/87, 345/98–100
See application file for complete search history.

(56) References Cited

U.S. PATENT DOCUMENTS

| | | | | |
|---|---|---|---|---|
| 5,657,041 | A * | 8/1997 | Choi | 345/99 |
| 6,091,393 | A | 7/2000 | Park | |
| 6,329,975 | B1 * | 12/2001 | Yamaguchi | 345/99 |
| 2003/0085860 | A1 * | 5/2003 | Baek | 345/87 |
| 2004/0100435 | A1 | 5/2004 | Baek et al. | |
| 2005/0168420 | A1 * | 8/2005 | Chung | 345/87 |
| 2005/0204274 | A1 * | 9/2005 | Kamp et al. | 714/801 |
| 2006/0274016 | A1 * | 12/2006 | Ito et al. | 345/98 |
| 2007/0164969 | A1 * | 7/2007 | Kim | 345/99 |
| 2007/0164970 | A1 * | 7/2007 | Oh | 345/99 |
| 2007/0262942 | A1 * | 11/2007 | Choi | 345/98 |
| 2008/0074378 | A1 * | 3/2008 | Chuang | 345/98 |

FOREIGN PATENT DOCUMENTS

| | | |
|---|---|---|
| JP | 2003228338 | 8/2003 |
| TW | 522352 | 3/2003 |

OTHER PUBLICATIONS

"Office Action of Japan Counterpart Application", issued on Sep. 6, 2011, p. 1-p. 4, in which the listed reference was cited.

"Office Action of Taiwan counterpart application" issued on Mar. 14, 2012, p. 1-p. 5, in which the listed references were cited.

* cited by examiner

*Primary Examiner* — Quan-Zhen Wang
*Assistant Examiner* — Tony Davis
(74) *Attorney, Agent, or Firm* — Jianq Chyun IP Office

(57) ABSTRACT

A method to generate control signals for a display-panel driver, which needs to receive a set of predetermined number of input signals so as to output a set of control signals. The method includes starting with a reset process. The display-panel driver receives a first part of the set of input signals through multiple input terminals. At least two of the input terminals are used as secondary input terminals, and at least two enabling input signals of different definitions are input, respectively. The enabling input signals internally enable a control signal generator to generate a second part of the set of input signals. The second part of the set of input signals and the first part of the set of input signals form a complete set of input signals. When a serial data of the input signals cannot satisfy the predetermined format, the method goes back to the reset process.

38 Claims, 10 Drawing Sheets

METHOD AND APPARATUS TO GENERATE CONTROL SIGNALS FOR DISPLAY-PANEL DRIVER

CROSS-REFERENCE TO RELATED APPLICATION

This application claims the priority benefit of Taiwan application serial no. 96117309, filed May 15, 2007. All disclosure of the Taiwan application is incorporated herein by reference.

BACKGROUND OF THE INVENTION

1. Field of the Invention

The present invention generally relates to a driving circuit of a display apparatus, more particularly, to a method and apparatus to generate control signals for a display-panel driver.

2. Description of Related Art

In the system structure of a conventional thin film transistor liquid crystal module, in order to attain the requirement of higher image quality or the goal of having a more efficient and more flexible system design applications, additional control lines between the controller and the source/gate driver are provided and additional chip pads corresponding to the source/gate driver are required to implement new driving control functions and function selection controls. This leads to inflexibility of function expansion and lowering of cost-effectiveness.

FIG. 1 is a diagram of a conventional thin film transistor liquid crystal display module. As shown in FIG. 1, the thin film transistor liquid crystal module 100 includes a liquid crystal panel 102, an X-PCB 104, a Y-PCB 106, a controller 108, source drivers SD1~SD8, gate drivers GD1~GD3, source driver films 110 and gate driver films 112, for example. Digital display data are processed by the controller and converted to a suitable data format and control signals. Together with clock signals CLK and GCLK used as reference for synchronous data reception, the data and control signals are sequentially transmitted to the source drivers SD1~SD8 and the gate drivers GD1~GD3.

FIG. 2 is a timing diagram of the control signals of a conventional source driver. As shown in FIG. 2, in order to save more power of the system, a conventional serial connection structure together with control signals serving as the control for enabling the driver on or off are deployed. For the source driver, the most basic control signals, aside from the start pulse SPI/SPO, include the latch signal STB and the polarity signal POL. However, in order to attain better image quality, newer driving control functions are continuously developed. To control these newly added functions, additional control lines between the controller and the source drivers are normally required. For example, the widely adopted Horizontal 2Dot Inversion function requires two additional control lines, namely, H-2DOT and POLC. In addition, in order to have more efficient and more flexible system design applications, the source driver also includes a number of function selection controls, for example, multi-channel selection, low power mode selection and charge sharing selection so as to provide the development requirements for different system applications. These added function selection controls require additional chip pads to implement the selection control.

FIG. 3 is a block diagram illustrating the functions of a conventional source driver. As shown in FIG. 3, a conventional source driver 300 includes a shift register 302, a data latch 304, a level shifter 306, a Digital-to-Analog Converter (DAC) 308, an output circuit 310, a clock input comparator 312, a data receiver 314, and a data register 316. Because the source driver 300 has to respond to different functions, input terminals are set up to receive a number of input signals, for example, HDOT, POLC, POL, . . . and so on, while corresponding control signals are output to drive the pixel for displaying data.

In other words, the input terminals of a conventional driver need to have chip pads. Therefore, a larger chip size is required and production cost is likely to increase. With the trend for market expansion and cost reduction, how to increase the number of control function of the product and simultaneously minimize the number of control pads for function selection is at the top of the product development goal.

SUMMARY OF THE INVENTION

Accordingly, the present invention provides a method to generate control signals for a display-panel driver. Some of the input terminals are allowed to input signals of different definitions according to the characteristics of the input signals so as to internally generate the originally required input signals and reduce the number of input terminals.

The present invention also provides a control signal generator that can generate an internally defined output signal according to different input signals.

The present invention also provides a control signal generation apparatus for a display-panel driver. By allowing some of the input terminals to input signals of different definitions according to the characteristics of the input signals, the originally required input signals are internally generated and hence reduce the number of input terminals.

According to an embodiment of the present invention, a method to generate control signals for a display-panel apparatus is provided. The display-panel driver needs to receive a set of predetermined number of input signals so as to output a set of control signals. The method includes starting with a reset process. The display-panel driver receives a first part of the set of input signals through multiple input terminals. At least two of the input terminals are used as secondary input terminals, and at least two enabling input signals of different definitions are input, respectively. The enabling input signals internally enable a control signal generator to generate a second part of the set of input signals. The second part of the set of input signals and the first part of the set of input signals form a complete set of input signals. When a serial data of the input signals cannot satisfy the predetermined format, the method goes back to the reset process.

According to the foregoing method to generate control signals in a preferred embodiment of the present invention, the secondary input terminals include a polarity signal input terminal and a latch signal input terminal, for example.

According to the foregoing method to generate control signals in a preferred embodiment of the present invention, the secondary input terminals include a XON input terminal and a XOE input terminal, for example.

According to the foregoing method to generate control signals in a preferred embodiment of the present invention, the generation of the second part of the set of input signals is enabled after at least two of the enabling input signals are identified, for example.

According to the foregoing method to generate control signals in a preferred embodiment of the present invention, the second part of the input signals includes a plurality of internal replacement signals defined in accordance to the secondary input terminals, for example.

According to the foregoing method to generate control signals in a preferred embodiment of the present invention, the number of input terminals of the display-panel driver is smaller than the number of predetermined input signals, for example.

The present invention also provides a control signal generator that includes at least one first input terminal and a second input terminal. A shift register receives multiple input signals of the first input terminal and the second input terminal and outputs a first signal and a second signal. A serial data check controller receives the input signals of the second input terminal and the first signal from the shift register and outputs an identification signal. Furthermore, a control signal generation unit receives the second signal of the shift register and the identification signal and generates a set of predefined control signals according to the input signals of the first input terminal and the second input terminal.

The present invention also provides a control signal generation apparatus. The display-panel driver needs to receive a set of predetermined number of input signals so as to output a set of control signals. The control signal generation apparatus includes a main control unit for receiving a first part of the set of input signals through multiple input terminals. At least two of the input terminals are used as secondary input terminals, and the input of at least two enabling input signals of different definitions are allowed, respectively. A control signal generator receives the enabling input signals so as to generate a second part of the set of input signals. The second part of the set of input signals and the first part of the set of input signals form a complete set of control signals and the set of control signals is output. When a serial data of the input signals cannot satisfy the predetermined format, the method goes back to the reset process.

In the present invention, the control signal generator allows the reception of signals of different definitions by the same terminal and internally generates part of the input signals that originally needs to be received so as to achieve internal input operation. Therefore, the number of input terminals is reduced.

In order to make the aforementioned and other objects, features and advantages of the present invention comprehensible, preferred embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
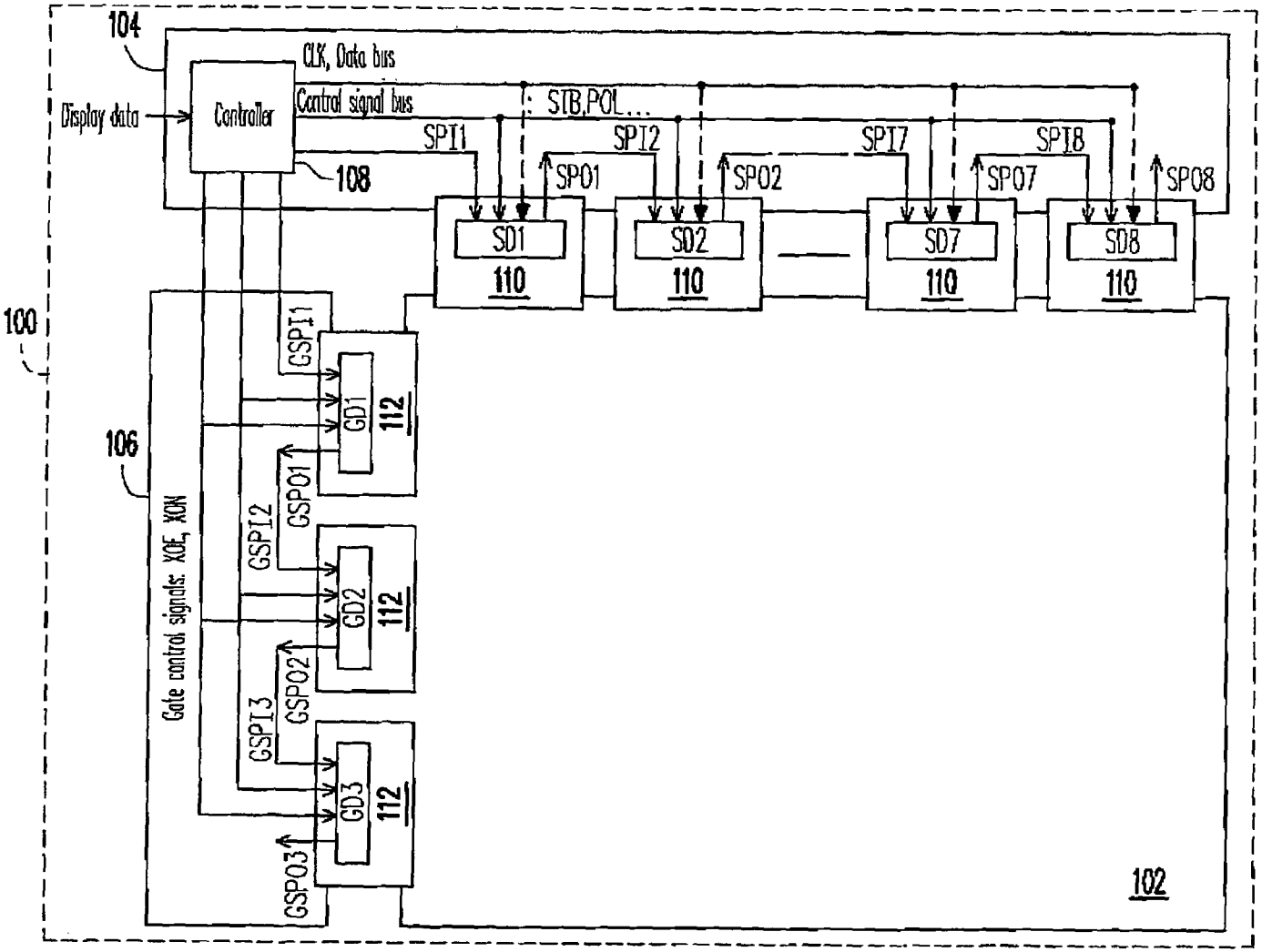
FIG. 1 is a structural diagram of a conventional thin film transistor liquid crystal display module.

Reference will now be made in detail to the present preferred embodiments of the invention, examples of which are illustrated in the accompanying drawings. Wherever possible, the same reference numbers are used in the drawings and the description to refer to the same or like parts.

The present invention provides, using the most basic control resources of the source/drain driver of a display panel, for example, the control lines such as CLK, POL, XOE and XON, an Embedded on Source-Control Signal Generator (EoS_CSG) and an Embedded on Gate-Control Signal Generator (EoG_CSG) so as to integrate the additional transmission interface control signals between the controller and the source/drain driver as well as the additional chip pads for other function selection signals of the source/drain driver. As a result, a simpler system with more flexibility for expansion, lower production cost and higher performance is designed.

In the following, a few embodiments of the present invention are described. However, the present invention is not limited by these embodiments.

Figure 4:
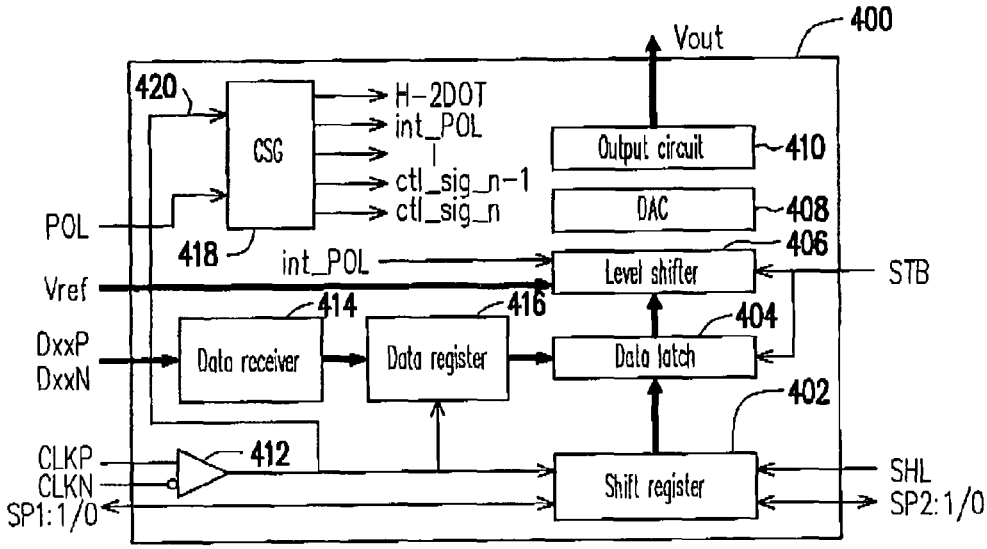
FIG. 4 is a block diagram illustrating the functions of a source driver according to an embodiment of the present invention.

FIG. 4 is a block diagram illustrating the functions of a source driver according to an embodiment of the present invention. As shown in FIG. 4, the source driver 400 of the present invention, for example, includes a shift register 402, a data latch 404, a level shifter 406, a digital-to-analog converter (DAC) 408, an output circuit 410, a clock input comparator 412, a data receiver 414, a data register 416, and a control signal generator (CSG) 418. Since the source driver 400 needs to correspond with different functions, the source driver 400 has a few basic input terminals for receiving basic input signals such as CLKP, CLKN, DxxP, DxxN, STB, POL and so on.

It should be noted that the embedded control signal generator 418 disposed within the structure of the present embodiment has at least two input terminals, for example, one input terminal for receiving the POL signal and one input terminal for receiving a signal 420 outputted from the clock input comparator 412. Through these two signal terminals, input signals of different definitions can be received and processed internally by the control signal generator 418 so as to generate internal signals corresponding to the driver input signal, for example, H-2DOT, int_POL, . . . , ctl_sig_n−1, and ctl_sig_n. Because the control signal generator 418 also uses the original POL signal terminal, the signal int_POL can replace the original POL signal.

Figure 2:
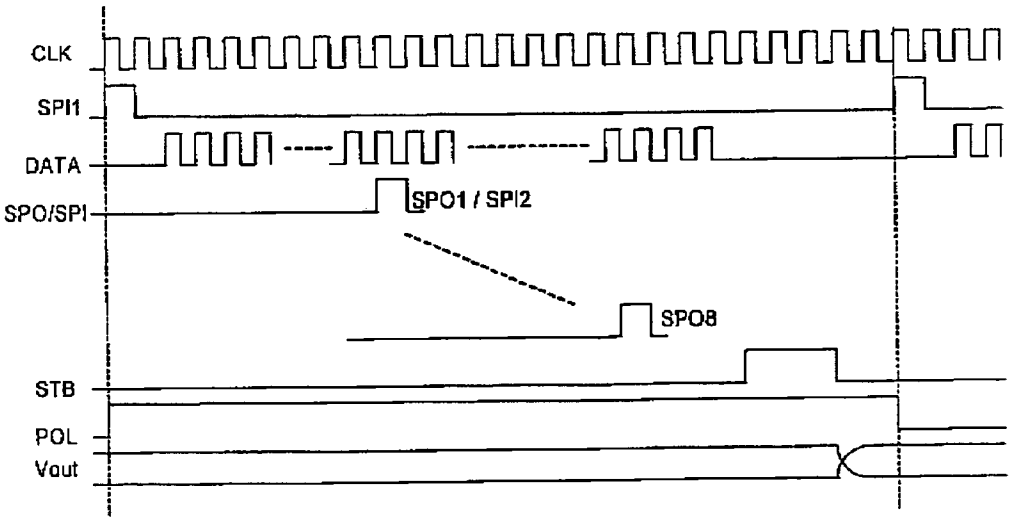
FIG. 2 is a timing diagram of the control signals of a conventional source driver.
Figure 3:
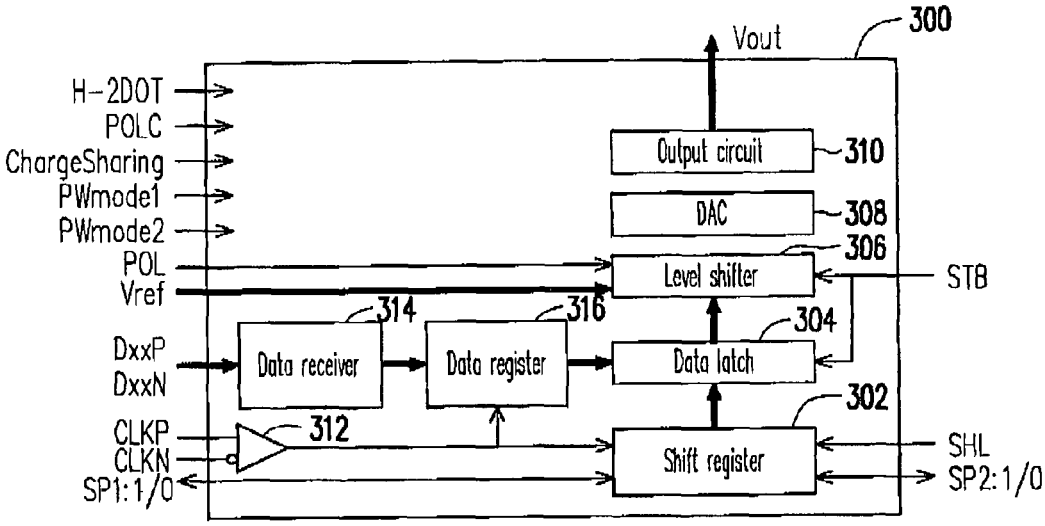
FIG. 3 is a block diagram illustrating the functions of a conventional source driver.
Figure 5:
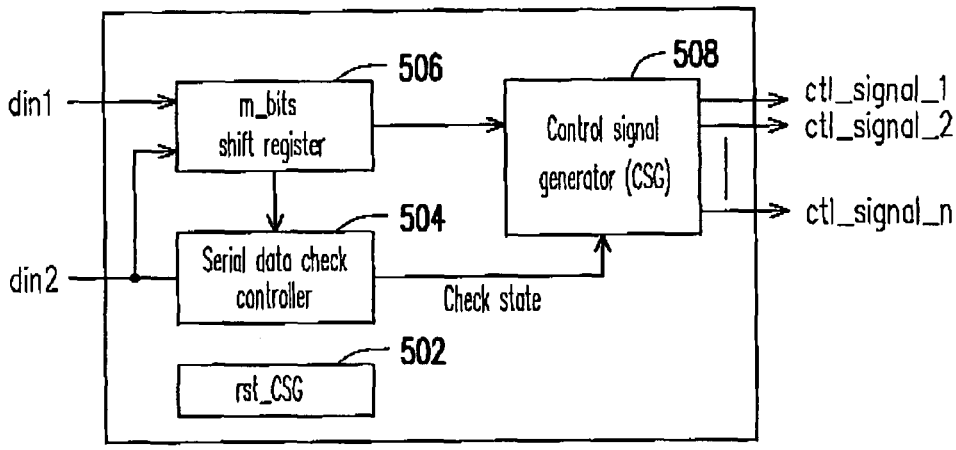
FIG. 5 is a block diagram of a control signal generator according to an embodiment of the present invention.

The reason for selecting the POL signal as an input terminal of the control signal generator 418 can be observed with reference to FIG. 2. As shown in FIG. 2, the POL signal is maintained at a level not producing any actions for quite a long period. Therefore, the POL signal can be effectively used without affecting other control functions. It can be clearly seen from the signal timing diagram corresponding to the source driver in FIG. 2 that the POL control signal has actual function only when the STB control signal transits from a low level to a high level. In other time periods, the POL control signal has no effect on the operating system. Therefore, the POL control signal and the CLK signal together are particularly suitable for serving as the input signals of the control signal generator according to the present invention. First, as shown in FIG. 5, the POL terminal is used as an input terminal din1 for transmitting a predefined specific data series and the CLK terminal is used as another input terminal din2 for providing an internal clock signal to the control signal generator to save the input data of the input terminal din1 in a data register. In addition, the input to the din2 terminal is also used to provide the control signals needed by the system to control various control mechanisms and data correction checks. By using the internal basic control signal resources of the source driver, the control signal generator 418 is embedded in the source driver to generate the required function control signals. Therefore, mechanisms for enhancing the application functions of a system are easily built without any side effects.

The present invention utilizes the control signal generator 418 to generate a part of the set of input signals that should be input. Therefore, at least the number of chip pads can be reduced. In other words, the number of chip pads is smaller than the number of input signals that the driver should receive so that some chip pads are saved.

FIG. 5 is a block diagram of a control signal generator according to an embodiment of the present invention. As shown in FIG. 5, the internal structure of the control signal generator 418 can include a reset unit (rst_CSG) 502 for returning to the control signals in the initial state. Other main functional blocks include a serial data check controller 504, a multi-bit shift register block 506 used as a data register, and a control signal generator (CSG) block 508. For example, using two input terminals, din1 and din2, as an example, the shift register block 506 receives the input signals of the input terminals din1 and din2 simultaneously. Furthermore, the serial data check controller 504 receives the signal of the input terminal din2 or the signal output from the shift register block 506. The control signal generator block 508 can output corresponding control signals ctl_Signal_1 . . . ctl_Signal_n to be used as input signals of the driver according to the input signal content. In the following, the operating mechanism of the control signal generator is further described.

The shift register block 506 is used for saving the data transmitted by the input signals. The serial data check controller 504 has a control and matching mechanism and includes a predefined specific data series information so as to provide the controller 504 with the execution of correct matching and the matching of the input data, and determine whether the matching result matches preset values. If there is an error in the matching, the input control command is regarded as incorrect. The control mechanism goes back to the reset initial state and waits for the matching of the next input data while the control signal output is unaffected by any change. If the matching is correct, the input control command is regarded as correct and the system performs the saving of the next input data according to the design until data register is filled. The filling of the data register indicates the input of data is complete and a matching with another predefined specific data series is performed. Data length and the number of matching of the matching mechanism are determined by the actual design. When the control matching mechanism is entirely satisfactory, the control command code being transmitted by the controller is verified. Therefore, the input and matching of the control signal enabling command are executed. The control signal generator block 508 predefines a few functional control signals according to functional requirements. Each functional control signal has a unique enabling command code. When a valid functional control signal enabling command code is correctly matched, the control signal generator block 508 outputs a corresponding control signal.

Figure 6:
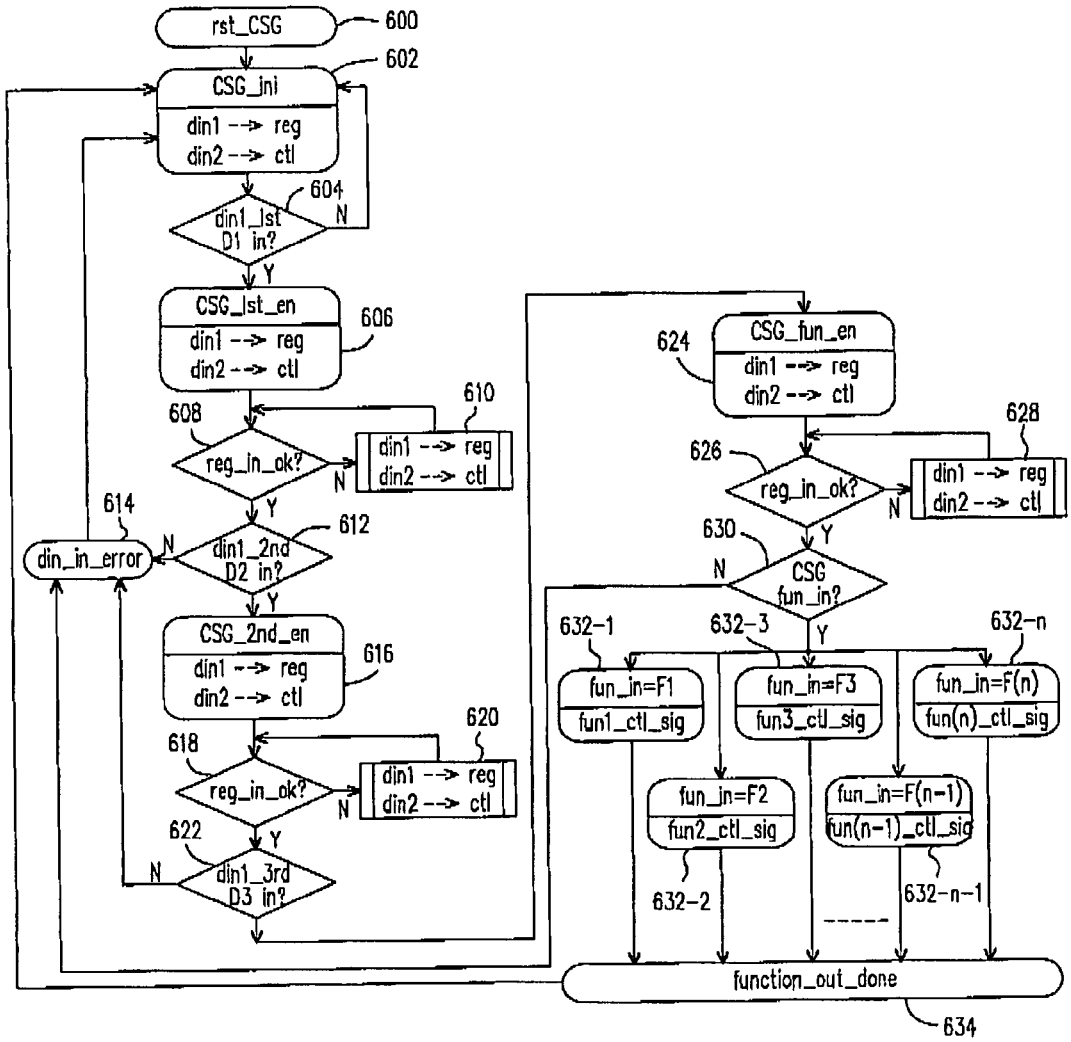
FIG. 6 is a flow diagram showing the mechanism of generating the control signals according to an embodiment of the present invention.

In the following, a flow chart of the operating mechanism is described. FIG. 6 is a flow diagram showing the mechanism of generating the control signals according to an embodiment of the present invention. As shown in FIG. 6, in step 600, the reset is enabled. In step 602, the data are transmitted from the input terminals din1 and din2 to the register (reg) 506 and the controller (ctl) 504. Then, in steps 606~622, matching checks are performed. In steps 624~634, corresponding control signals 632-1, 632-2, . . . , **632-*n*** are generated according to the input data.

In other words, the control signal generator controls its operation through a series of predefined data series. Through the input of a series of serial data and the execution of matching operations, the reliability of the control signal generator (CSG) mechanism in operation is ensured. In the description of the present embodiment, assume that the control mechanism needs to input a data series including D1, D2, D3 and Fx (F1~Fn) in order to correctly control and generate the expected control signal output. After outputting a functional control signal, the output of other functional control signals can be similarly controlled. When a series of input data cannot completely satisfy the predefined specific data, the control mechanism goes back to the reset initial state. The control signal output are unaffected by any changes. In the system control operation of FIG. 6, assume that the control mechanism executes three m-bit "control command code" matching and a single "enabling command code" matching. Assume that m-bits represent 8-bit data register and the three "control command code" are sequentially E6, 5A and A5. Finally, assume that the "enabling command code" has 5 groups, represented by B1~B5, corresponding to preset functional control signal output according to system control requirements. Consequently, after inputting the data E6 and executing a correct matching, the control matching is followed by inputting the 5A data and executing another matching. After executing a correct matching, the data A5 is input and another matching is executed. After executing a correct matching, one of the "enabling command codes" B1~B5 is input to assign which of the function control signals will be output.

It should be understood that the mechanism in FIG. 6 is only one of the possible means of implementation, but not the only means of implementation. The purpose of the present invention is to select a not-so-frequently-changing signal terminal to carry two differently defined signals and use the control signal generator to internally generate the input signals required by the driver.

Figure 7:
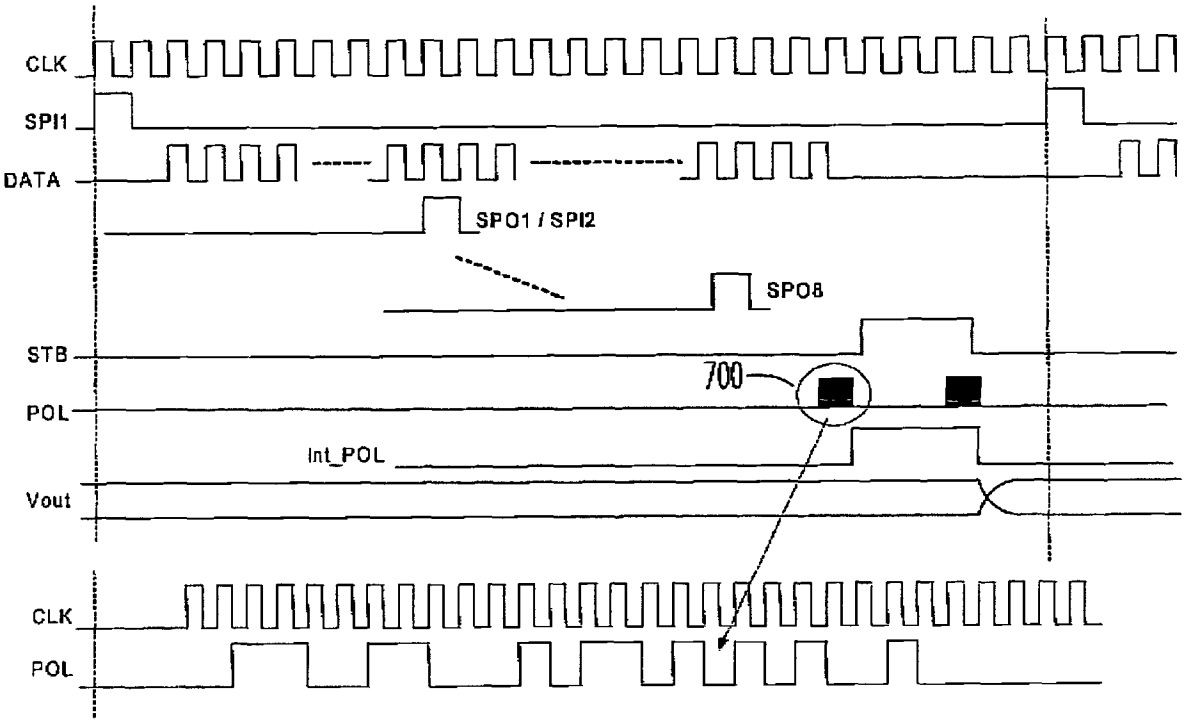
FIG. 7 is a timing diagram of input signals according to an embodiment of the present invention.

FIG. 7 is a timing diagram of input signals according to an embodiment of the present invention. As shown in FIG. 7, the embodiment of the present invention uses two control signals STB and POL as the input signals of the control signal generator (CSG). The POL (or STB) signal is used as din1 input for transmitting predefined specific data series and STB (or POL) signal is used as din2 input for providing an internal clock signal to the CSG system. Here, int_POL corresponds to the time 700 generation and is used to replace the POL signal. The actual POL input terminal can input other defined signals within other inaction period so as to generate part of the input signals of the embedded CSG.

Figure 8:
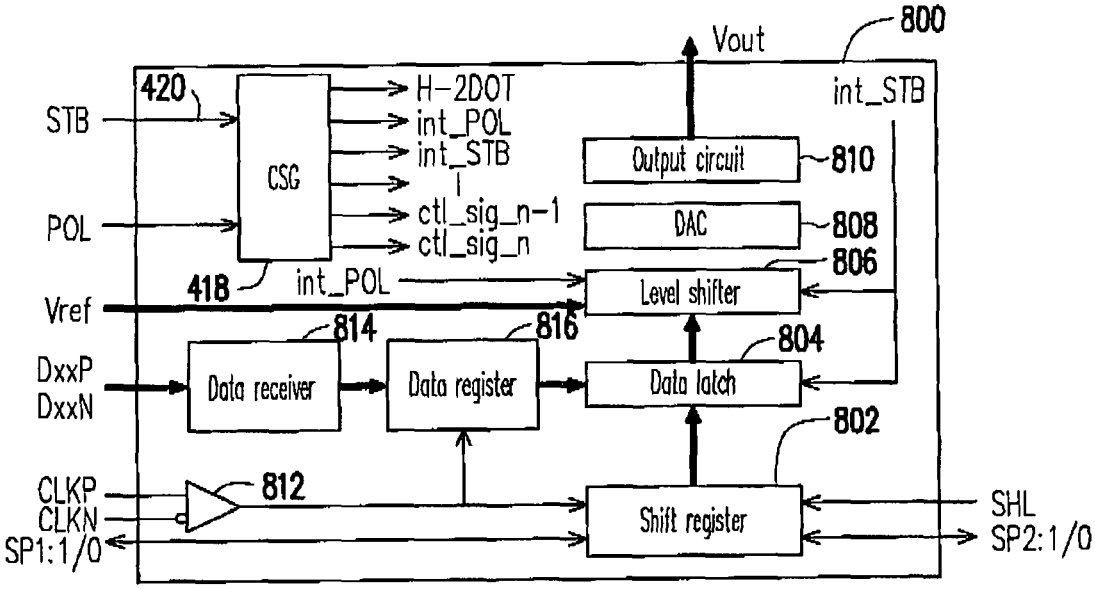
FIG. 8 is a block diagram illustrating the functions of a source driver according to another embodiment of the present invention.

FIG. 8 is a block diagram illustrating the functions of a source driver according to another embodiment of the present invention. Using the same principles described above, FIG. 8 is very similar to FIG. 4 but is based on the mechanism in FIG. 7. That is, the input terminals of POL and STB are used in the operation. In other words, CSG 418 receives the input signals of the input terminals POL and STB. In the inaction period, input signals corresponding to the driver are generated. The source driver 800 of the present invention further includes a shift register 802, a data latch 804, a level shifter 806, a digital-to-analog convert (DAC) 808, an output circuit 810, a clock input comparator 812, a data receiver 814, a data register 816, and a CSG 418. An input terminal of the CSG 418 is connected to the input terminal POL and another input terminal is connected to the input terminal STB.

Figure 9:
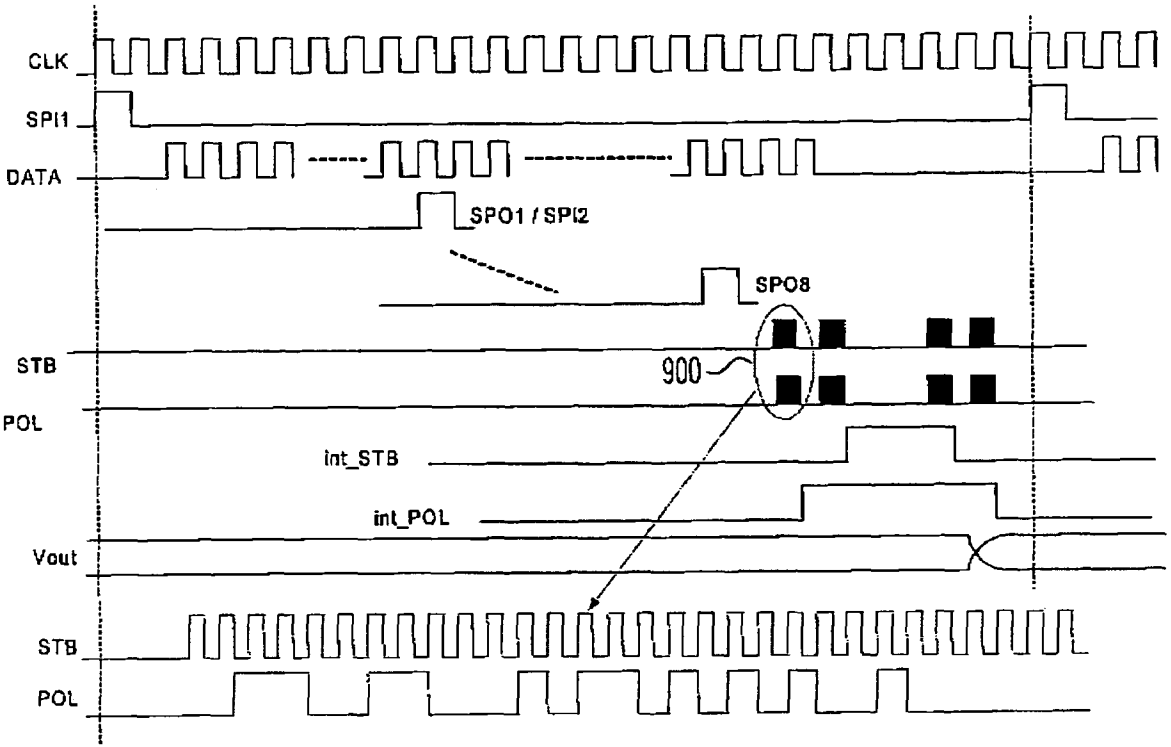
FIG. 9 is a timing diagram of input signals according to another embodiment of the present invention.

FIG. 9 is a timing diagram of input signals according to another embodiment of the present invention. As shown in FIG. 9, compared with FIG. 7, the signals STB and POL also simultaneously generate their corresponding internal signals int_STB and int_POL at corresponding time. In the present embodiment, the two control signals STB and POL are used as the input signals of the control signal generator (CSG). Either the POL or the STB is used as the din1 input for transmitting the predefined specific data series while the other one of the STB or POL is used as the din2 input for providing an internal clock signal to the CSG system.

Figure 10:
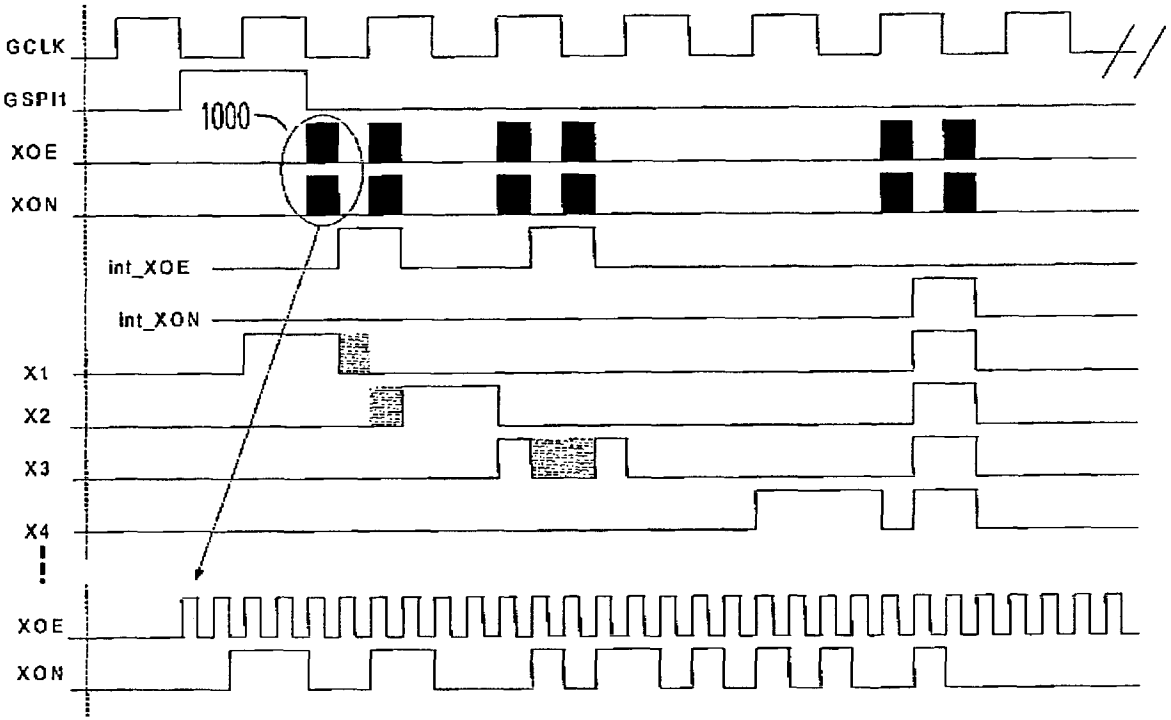
FIG. 10 is a timing diagram of an embedded control signal generator of a gate driver according to an embodiment of the present invention.

According to the same application concept, the embedded control signal generation apparatus of a gate driver can be implemented. FIG. 10 is a timing diagram of an embedded control signal generator of a gate driver according to an embodiment of the present invention. As shown in FIG. 10, from the perspective of the signal timing diagram corresponding to the gate driver, the present embodiment utilizes the two control signals XOE and XON as the input signals of the control signal generator (CSG) required by the present invention. The XON (or the XOE) signal is used as the din1 input for transmitting predefined specific data series and the XOE (or the XON) is used as din2 input for providing an internal clock signal to the CSG system. According to the same application concept, the embedded control signal generation apparatus of the gate driver can be implemented.

Figure 11:
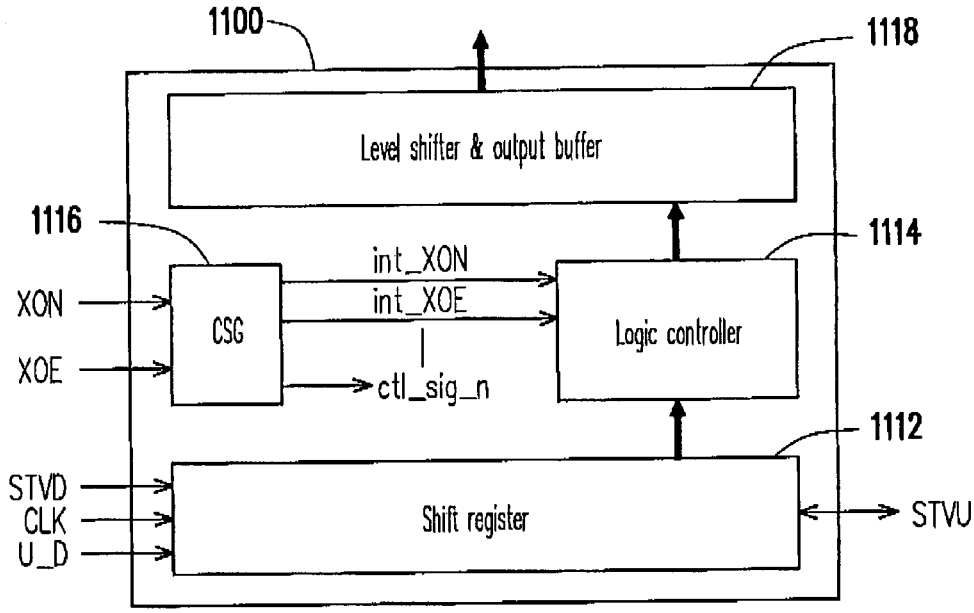
FIG. 11 is a circuit block diagram corresponding to the control signal generator in FIG. 10 according to another embodiment of the present invention.

FIG. 11 is a circuit block diagram corresponding to the control signal generator in FIG. 10 according to another embodiment of the present invention. As shown in FIG. 11, the control signal generator 1100 embedded in the gate driver is, for example, using the signals XON and XOE as the input signals of the control signal generator (CSG) 1116 in the control signal generator 1100. According to the aforementioned mechanism aimed at the source driver, the control signal generator (CSG) 116 inside the gate driver is connected to the input terminals of the receiving signals XON and XOE, and generates other required input signals ctl_sig_n according to the control state. Furthermore, internal replacement signals int_XON and int_XOE are also generated, for example. In general, the gate driver includes, for example, a shift register 1112, a logic controller 1114, a control signal generator (CSG) 1116, and a level shifter & output buffer 1118. The input signals XON and XOE are received through the control signal generator (CSG) 1116.

In the foregoing embodiment, if the control signals are preset and fixed signal output as shown in FIG. 4, only one set of control signal enabling command codes can be used to control, for example. If the control signal can control the signal output according to the application, as shown in FIGS. 8 and 11, then a particular function control signal may require at least two sets of control signal enabling command codes as control applications, for example. However, this is just a different variation under the same operating principles.

Figure 12:
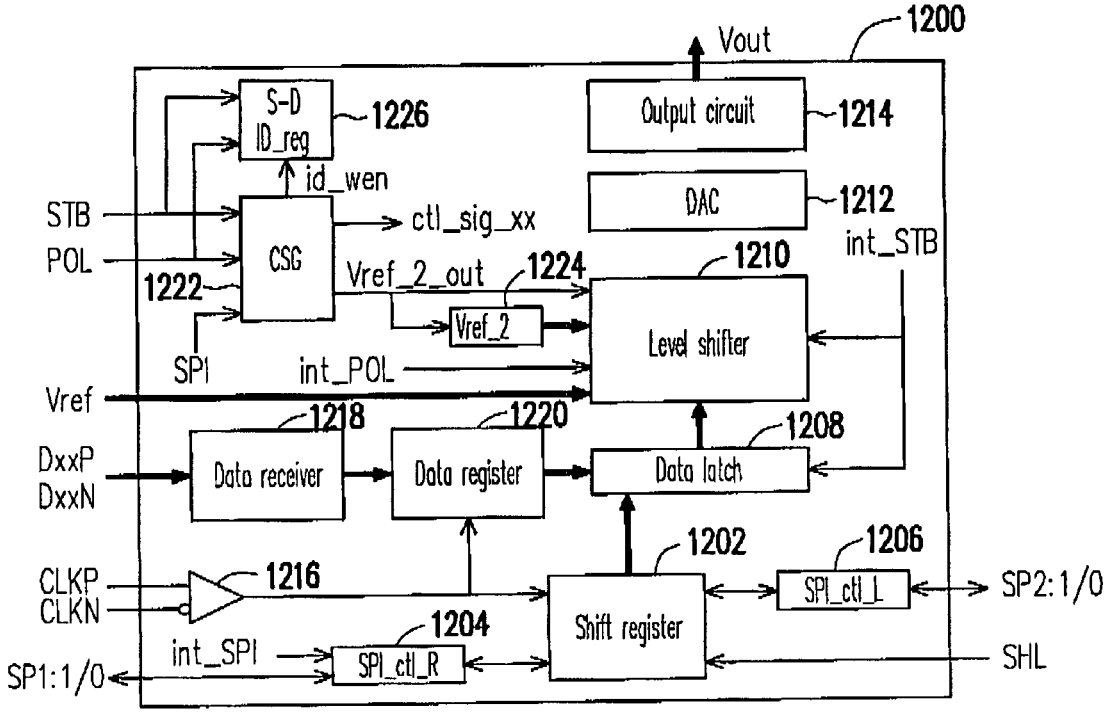
FIG. 12 is a block diagram illustrating the functions of a source driver according to another embodiment of the present invention.

FIG. 12 is a block diagram illustrating the functions of a source driver according to another embodiment of the present invention. As shown in FIG. 12, according to different application requirements and working with other usable signals, a source driver having more sophisticated function control mechanism and broader applications can be implemented. As shown in FIG. 12, the source driver 1200 includes a shift register 1202, a data latch 1208, a level shifter 1210, a digital-to-analog converter (DAC) 1212, an output circuit 1214, a clock input comparator 1216, a data receiver 1218, a data register 1220, and a control signal generator 1222. In addition, the source driver 1200 further includes SPI_ctl_R 1204, SPI_ctl_L 1206, Vref_2 1224 and an identification apparatus (S-D ID-reg) 1226. The present embodiment increases the utilization of SPI control signal resources so that the control mechanism of the control signal generator (CSG) can have a broader application. For example, separately defined identification apparatus (S-D ID-reg) 1226 can be implemented in the source driver or more advanced output control can be applied to the output control of the source driver. The establishment and design of these control mechanisms can be applied according to the system. With regard to the application of the separately defined identification mechanism 1226 within the source driver, the present invention provides a data transmission mode with non-essential serial connection structure. Through the control application of this apparatus, an external controller can flexibly enable anyone of the controllers to transmit data to a corresponding driver according to the requirements.

The system structure of the currently most common TFT LCD module uses the data transmission mode of a serial connection structure. First, the controller needs to transmit a start pulse signal to a first driver and transmits data to the corresponding driver so as to enable this driver to receive the data. After receiving the data, the driver transmits a start pulse out signal to the next driver stage so as to enable the next driver stage to receive data from the controller. In this way, data from the controller are received stage after stage in sequence. Finally, the output stages of all the drivers are enabled to output corresponding voltages. With this structure, problems are encountered when a system application requiring a higher operating frequency is needed. Because it is impossible to avoid clock skew and printed circuit board (PCB) path delay, the start pulse signal may encounter hidden reliability problem or may become the main bottleneck that limits the highest operating frequency of the system. One way to resolve this problem is to break up the serial connection structure so that the controller can independently enable the drivers to complete the data transmission work. In the present embodiment, the identification mechanism (S-D ID-reg) inside the source driver can combine a slow frequency clock using the data transmission mode of the original serial connection structure with the control signal generator (CSG) for inputting an identification code to the identification apparatus (S-D ID-reg) of each driver. After inputting all the identification codes into the identification apparatus of the drivers, the system can start a high frequency operating mode.

In other words, the subsequent application in the foregoing description of the present invention is that the control signal generator allows at least two sets of differently defined input signals. Therefore, the normal operations of the drivers will not be affected. Furthermore, under the most important precondition of reducing the number of chip pads, the present invention can still provide more additional functions.

In summary, the present invention proposes using some of the signal input terminals that are allowed by the driver as multiply defined input terminals. Through the control signal generators, the corresponding input signals are generated and other extra functions can also be added with greater flexibility. As a result, new and additional operating applications can be provided without having to change the driver.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method to generate control signals for a display-panel driver, wherein the display-panel driver needs to receive a predetermined number of a set of input signals so as to output a set of required control signals, the method implemented in the display-panel driver comprising:

starting a reset process;

receiving a first part of the set of input signals through a plurality of input terminals of the display-panel driver;

using one of the input terminals as a secondary input terminal with double definition for inputting an enabling input signal, wherein the enabling input signal enables an internal control signal generator to generate a second part of the set of input signals, and the second part of the set of input signals and the first part of the set of input signals form the complete set of input signals; and going back to the reset process when a serial data of the input signals do not completely satisfy a predetermined format.

2. The method to generate control signals of the display-panel driver according to claim 1, wherein the secondary input terminal comprises a polarity signal input terminal or a latch signal input terminal.

3. The method to generate control signals of the display-panel driver according to claim 1, wherein the secondary input terminal comprises a XON input terminal or a XOE input terminal.

4. The method to generate control signals of the display-panel driver according to claim 1, wherein the generator for generating the second part of the set of input signals is enabled after the enabling input signal is identified.

5. The method to generate control signals of the display-panel driver according to claim 1, wherein the second part of the set of input signals comprises a plurality of internal replacement signals defined to correspond to the secondary input terminal.

6. The method to generate control signals of the display-panel driver according to claim 1, wherein the number of the input terminals of the display-panel driver is smaller than the number of the predetermined input signals.

7. A control signal generation apparatus of implemented in a display-panel driver, wherein the display-panel driver needs to receive a set of predetermined number of input signals so as to output a set of required control signals, the apparatus comprising:

a main circuit unit, for receiving a first part of the set of input signals through a plurality of input terminals;

one of the input terminals, set as a first secondary input terminal and allowing to further input with an enabling input signal with a different definition; and a control signal generator, for receiving the enabling input signal so as to generate a second part of the set of input signals and forming a complete set of output signals together with the first part of the set of input signals, and outputting the set of control signals;

wherein the reset process is enabled when a serial data of the input signals do not completely satisfy a predetermined format.

8. The control signal generation apparatus of the display-panel driver according to claim 7, wherein the control signal generator comprises:

at least one first input terminal and one second input terminal, respectively used as the first secondary input terminal and a second secondary input terminal;

a shift register, for receiving a plurality of input signals of the first input terminal and the second input terminal and outputting a first signal and a second signal;

a serial data check controller, for receiving the input signal of the second input terminal and the first signal from the shift register, and outputting an identification signal; and a control signal generation unit, for receiving the second signal of the shift register and the identification signal, and generating a predefined set of control signals according to the input signals of the first input terminal and the second input terminal.

9. The control signal generation apparatus of the display-panel driver according to claim 8, wherein the first input terminal and the second input terminal receive a first type of defined signal or a second type of defined signal, and the second type of defined signal generates the set of control signals.

10. The control signal generation apparatus of the display-panel driver according to claim 9, wherein the set of control signals comprises a first set of signals corresponding to the first type of defined signal and an additional second set of signals.

11. The control signal generation apparatus of the display-panel driver according to claim 7, further comprising a reset unit, used for resetting the control signal generator.

12. The control signal generation apparatus of the display-panel driver according to claim 7, wherein the control signal generator is embedded in a source driver of the main circuit unit.

13. The control signal generation apparatus of the display-panel driver according to claim 7, wherein the control signal generator is embedded in a gate driver of the main circuit unit.

14. A method to generate control signals for a display-panel driving system, wherein a display-panel driver needs to receive a set of input signals so as to output a set of control signals, the method implemented in the display-panel driver comprising:

receiving the set of the input signals by a plurality of input terminals of the display-panel driver;

comparing a first signal received by a first terminal of the input terminals with a preset signal, to check whether or not a correct status to receive a second signal;

receiving the second signal from the first terminal of the input terminals after comparing the first signal with the preset signal and verifying as the correct status; and generating a plurality of first control signals according to the second signal with a definition, wherein the first control signals is a sub-set of the set of the input signals.

15. The method of claim 14, further comprising receiving a clock signal received by a second terminal of the input terminals, wherein the clock signal is used to read the first signal.

16. The method of claim 15, wherein the first signal and the clock signal are redefined as a polarity signal and a latch signal.

17. The method of claim 15, wherein the first signal and the clock signal are redefined as a XON signal and a XOE signal.

18. The method of claim 14, wherein the display-panel driver is a source driver.

19. The method of claim 14, wherein the first signal is a polarity signal.

20. The method of claim 14, wherein the first signal is a latch signal.

21. The method of claim 14, wherein the display-panel driver is a gate driver.

22. The method of claim 14, wherein the first signal is a XON signal.

23. The method of claim 14, wherein the first signal is a XOE signal.

24. The method of claim 14, wherein the display-panel driver is a timing control driver.

25. A signal generator to generate control signals for a display-panel driving system, wherein a display-panel driver needs to receive a set of input signals so as to output a set of control signals, the signal generator implemented in the display-panel driver comprising:

a main circuit unit, receiving the set of the input signals by a plurality of input terminals of the display-panel driver; and a control signal generator, taking a first signal received by a first terminal of the input terminals with double definition and comparing the first signal with a preset signal, wherein after the first signal is compared with the preset signal and verified as a correct result to receive a second signal, the first terminal receives the second signal, and a plurality of the first control signals are internally generated according to the second signal, wherein the first control signals are a sub-set of the set of the input signals.

26. The signal generator of claim 25, wherein the control signal generator comprises:

a first input end and a second input end, respectively coupled to the first terminal and a second terminal of the input terminals;

a shift register, for receiving a number of input signals from the first input end and the second input end and outputting a third signal and a fourth signal;

a serial data check controller, for receiving the input signal of the second input end and the third signal from the shift register and outputting an identification signal; and a control signal generation unit, for receiving the fourth signal of the shift register and the identification signal and generating a predefined set of control signals according to the input signals of the first input end and the second input end.

27. The signal generator of claim 25, wherein the second terminal receives a clock signal.

28. The signal generator of claim 25, further comprising a reset unit for resetting the control signal generation unit.

29. The signal generator of claim 25, wherein a clock signal is received from a second terminal of the input terminals, and the first signal is read according to the clock signal.

30. The signal generator of claim 29, wherein the first signal and the clock signal are a polarity signal and a latch signal.

31. The signal generator of claim 29, wherein the first signal and the clock signal are a XON signal and a XOE signal.

32. The signal generator of claim 25, wherein the signal generator is a source driver.

33. The signal generator of claim 25, wherein the first signal is a polarity signal.

34. The signal generator of claim 25, wherein the first signal is a latch signal.

35. The signal generator of claim 25, wherein the signal generator is a gate driver.

36. The signal generator of claim 25, wherein the first signal is a XON signal.

37. The signal generator of claim 25, wherein the first signal is a XOE signal.

38. The signal generator of claim 25, wherein the signal generator is a timing control driver.

* * * * *